United States Patent [19]

Roth

[11] 4,119,202

[45] Oct. 10, 1978

[54] PACKAGE

[76] Inventor: Lee J. Roth, c/o Kooltone Inc., 74 Mall Dr., Commack, N.Y. 11725

[21] Appl. No.: 847,138

[22] Filed: Oct. 31, 1977

[51] Int. Cl.[2] ..... B65D 75/06

[52] U.S. Cl. ..... 206/432; 206/497; 229/52 B

[58] Field of Search ..... 206/431–432, 206/497, 526; 229/34 R, 52 B, DIG. 12

[56] References Cited

U.S. PATENT DOCUMENTS

| | | | |
|---|---|---|---|
| 3,425,543 | 2/1969 | Harvey | 206/432 |
| 3,474,949 | 10/1969 | Shine | 229/52 B UX |
| 3,515,272 | 6/1970 | Von Gal | 206/497 X |
| 3,567,014 | 3/1971 | Feigelman | 229/34 R X |
| 3,664,494 | 5/1972 | Mergens | 229/52 B |
| 3,737,094 | 6/1973 | Beaver et al. | 229/34 R |
| 3,746,160 | 7/1973 | Thompson et al. | 206/432 X |
| 3,826,357 | 7/1974 | Roth | 206/497 X |
| 4,036,364 | 7/1977 | Ambrose | 206/497 X |

*Primary Examiner*—Steven E. Lipman
*Attorney, Agent, or Firm*—Bauer & Amer

[57] ABSTRACT

A package for products grouped or assembled for ease of handling, shipping, etc., which includes an outer protective plastic cover that may be selectively ruptured incident to removal from the assembly of some products, while a desired packaged condition is nevertheless effectively maintained for the remaining, yet unused, products. To a significant extent, said effectively maintained packaged condition is the result of wall constructions in the individual product containers which serve as internal supports for the outer plastic cover.

2 Claims, 6 Drawing Figures

PACKAGE

The present invention relates generally to improvements in packaging for products shipped and/or marketed in carrying containers, and more particularly to improvements embodied by such packaging that readily allows for partial removal of the products without an accompanying destruction of the package, i.e. a partial product removal following which the remaining, yet unused, products remain in their original effectively packaged condition in which, for example, said remaining products are still protected by the plastic cover of the package, the carrying containers thereof retain their ability to be stacked, and the package continues to provide other such benefits.

The use of folding cardboard blanks to form carrying containers for multiple products, a common example of which is the so-called "six-pack", are undoubtedly popular because of their contribution to the convenience in stacking, handling and shipping, as well as the enhancement they provide to the point-of-sales display of the products. However, when less than all of the products are purchased, or there is otherwise a partial removal of products from the "six-pack", the advantages provided by this type of package are significantly diminished. Among other shortcomings for example, if the "six-pack" is of the type initially protected by an outer plastic film or cover, the rupture of said plastic cover incident to removal of some of the products invariably totally destroys or otherwise results in the total ineffectiveness of the plastic cover to continue to function in a useful manner for the yet unused products contained in the "six-pack".

Broadly, it is an object of the present invention to provide an improved multi-container package overcoming the foregoing and other shortcomings of the prior art. Specifically, it is an object to package multiple containers or carriers, each containing appropriate products, in an assembly effectively integrated as a unitary package by an enclosing protective plastic film or cover, in which partial product removal from the assembly is readily achieved without destroying or inadvertently detracting from the conveniences provided by the unitary package.

An improved package for assembled products of the type involved herein, which demonstrates objects and advantages of the present invention is one which, as already noted, has an outer plastic protective film, the same being disposed in covering relation about at least three identically constructed product containers arranged in side-by-side relation. Each said container, in turn, includes a cooperating pair of back walls interconnected along an upper edge thereof and disposed in back-to-back contact with each other such that each is in facing relation to a product-storage compartment. A pair of side walls, of the same height as the back walls, extend laterally from along opposite sides of each said back wall to cooperate therewith in bounding said container product-storage compartment. As a result, the adjacent position of the back walls provides a corresponding adjacent position in each said pair of side walls and this, in turn, contributes to the functioning of the side walls as plastic film-supports oriented laterally of and at spaced locations along the package. In practice, therefore, following the selected rupture of the plastic film incident to the removal of an end container, the unruptured remaining portion of the plastic is still effectively supported in covering relation about the remaining two containers by the support function of the side walls of said remaining containers.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 1:
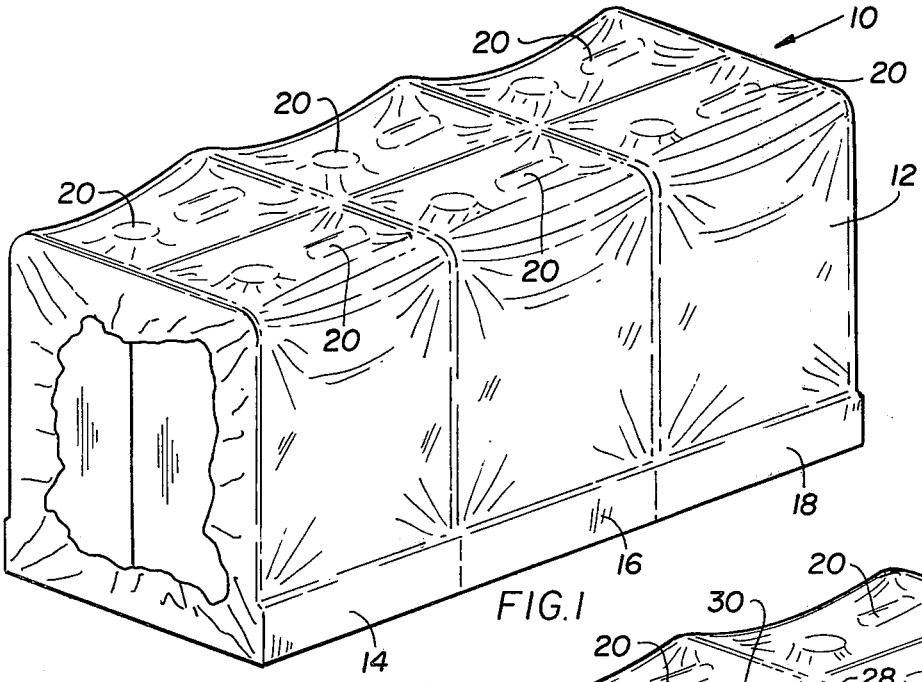
FIG. 1 is a perspective view of an improved package according to the present invention.

There are, of course, many prior art cardboard blanks that are foldable from the flat into a three dimensional construction which bounds a storage compartment for one or more products sized to fit in the compartments formed by the resulting three dimensional construction. One such prior art cardboard blank is described and illustrated in U.S. Pat. No. 3,167,212. Among other differences, the improved package of the present invention is one that is effectively used for an assembly of products and is particularly characterized in that it allows for the partial removal from said assembly of some of the products while a packaged condition is effectively maintained for the remainder thereof. Thus, as may be readily appreciated from a comparison of FIGS. 1 and 2, the improved package according to the present invention, generally designated 10, consists of an outer plastic protective film or cover 12 which, in a well understood procedure, is disposed loosely over and then shrunk about three identically constructed product containers 14, 16 and 18. More particularly, in the preferred embodiment illustrated herein, each container is used for the storage of two products which, in the illustrated embodiment, is a plastic bottle of liquid anti-freeze, individually and collectively designated 20. The anti-freeze containers 20 are typically used one at a time and thus, as clearly illustrated in FIGS. 1, 2, it is a relatively simple matter in removing the end container 14 to appropriately selectively rupture the protective plastic film 12, as at the location 22, which of course readily permits removal of the container 14 with its product contents. Once removed, one of the two bottles 20 is then, in turn, removed from its product storage compartment 24.

Figure 2:
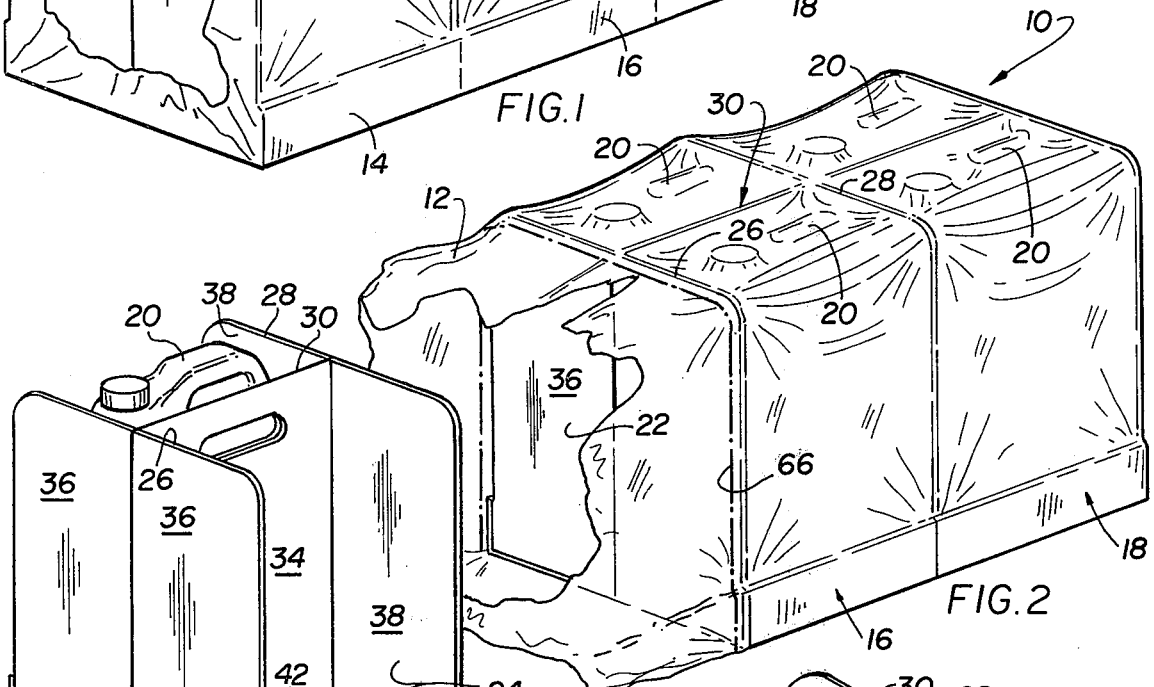
FIG. 2 is similarly a perspective view of said package, but illustrating the removal of one of the containers hereof and the continuing packaged condition which exists for the remaining containers.

A significant contribution of the improved package 10 according to the present invention is perhaps best illustrated in FIG. 2. Referring to that figure, it will be noted that despite the rupture in the plastic film 12 at location 22 that the remainder of the film remains effectively in covered relation about the remaining containers 16 and 18, and thus maintains these containers in their original packaged condition. As will be explained in greater detail subsequently, the unruptured plastic film 12 is able to effectively retain the packaged condition for the containers 16, 18 primarily due to the fact that the side walls of these containers function as film-supports oriented laterally of and at spaced locations along the package 10, as at 26 and 28. Cooperating with the laterally oriented supports 26 and 28 is a lengthwise oriented support edge 30. As a result of these supports, at 26, 28 and 30, the unruptured portion of the plastic cover 12 remains effectively enclosed about the containers 16 and 18 and, of course, about their product contents, all to the end of significantly contributing to the ease of handling of the yet unused products 20, as well as minimizing their unauthorized removal when displayed for retail, as well as providing other benefits.

Figure 4:
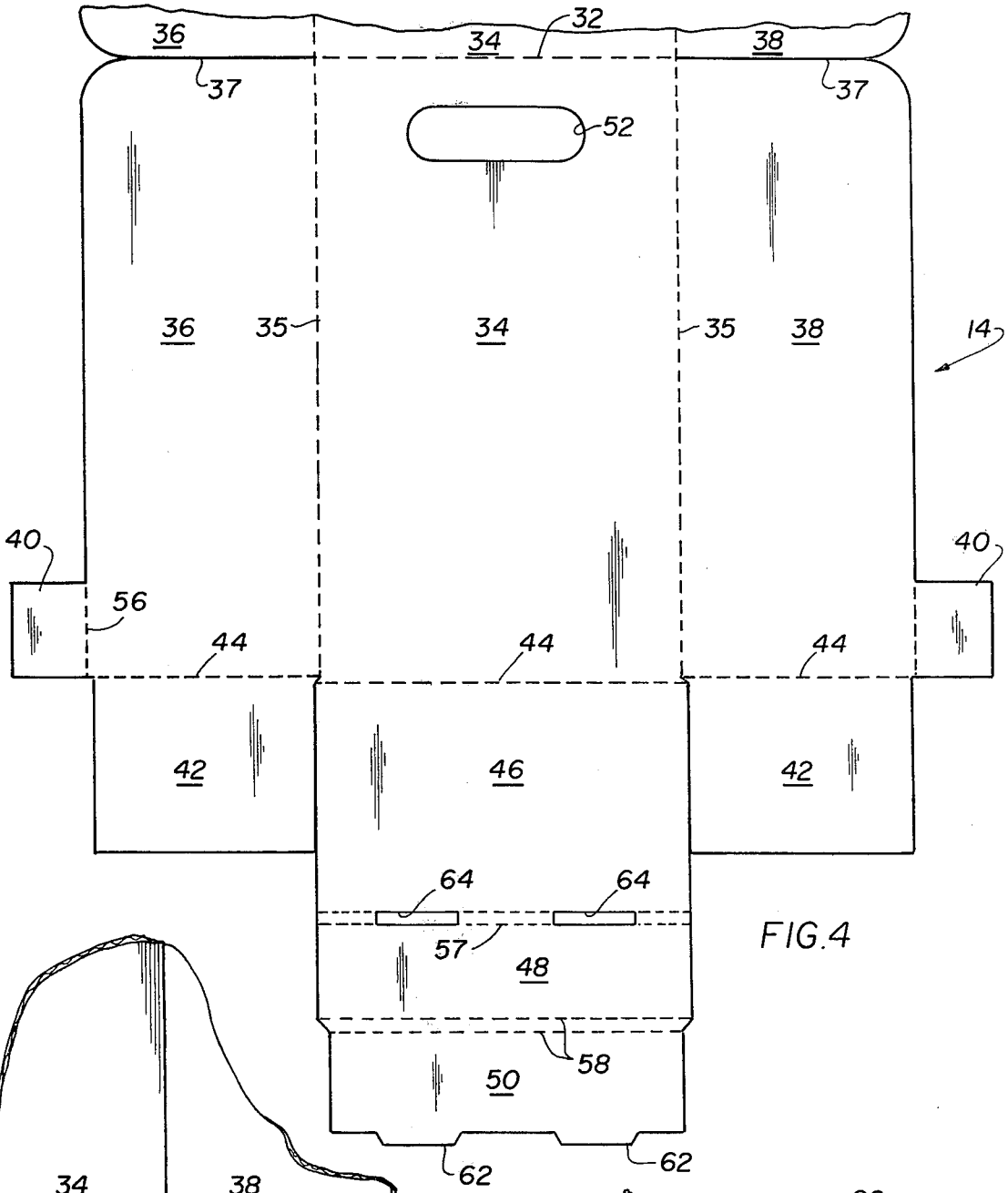
FIG. 4 is a partial plan view illustrating the cardboard blank preparatory to the folding thereof into the three dimensional container of FIG. 3.

Since, as already noted, each of the containers 14, 16 and 18 are identically constructed, the detailed description of the construction of the cardboard blank which results in the container 14 should suffice for a complete understanding of the invention. Said container 14, as is perhaps best illustrated in FIG. 4, is comprised of a blank, preferably constructed of cardboard, which is symmetrical with respect to a fold line 32 which ultimately becomes the upper edge of the container. That is, container 14 is formed of a cardboard blank which has two back walls 34 joined to each other along said fold line 32, and having two side walls 36 and 38 attached along opposite sides thereof, as along the fold lines 35. The adjacent pair of side walls 36 and 38 are unattached to each other at their confronting edges 37.

Completing each side wall 36 and 38 are two locking flaps 40 and 42, respectively, the utility of which in providing the three dimensional configuration to each container will soon be apparent.

Extending from the bottom of each back wall 34 and delineated therefrom by the fold line 44 are three interconnected flaps 46, 48 and 50 which, as will soon be described, are readily adapted to fold relative to each other in forming a bottom tray for the previously noted product-storage compartment 24.

Figure 3:
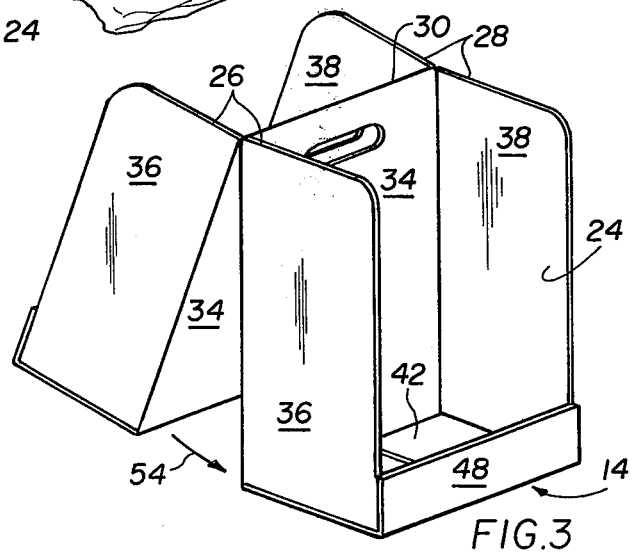
FIG. 3 is a perspective view of one of the cardboard containers which is part of the within improved package.

The contemplated method of erecting the container 14 is as follows. The cardboard blank is first folded along the fold line 32 which brings the two aligning hand grip openings 52 in each of the back walls 34 together to form a single hand grip opening when said back walls are brought into physical contact with each other as a result of movement 54, as illustrated in FIG. 3.

Next, the side walls 36 and 38 are folded laterally along the fold lines 35 with respect to the back wall 34, such that said side walls in their adjacent position form, in effect, a continuous wall structure that extends laterally of the package 10. It is these adjacently located side walls 36 and 38 which function as the film-supports at the locations 26 and 28, as previously noted. To enable said side walls 36 and 38 to function as supporting structure for the outer protective film 12, these side walls are made the same height as the back walls 34 so that the upper edges of the side walls and back wall are, in effect, a support grid, comprised of the edges 26, 28 and 30, for the film 12, all as has already been noted.

Figure 5:
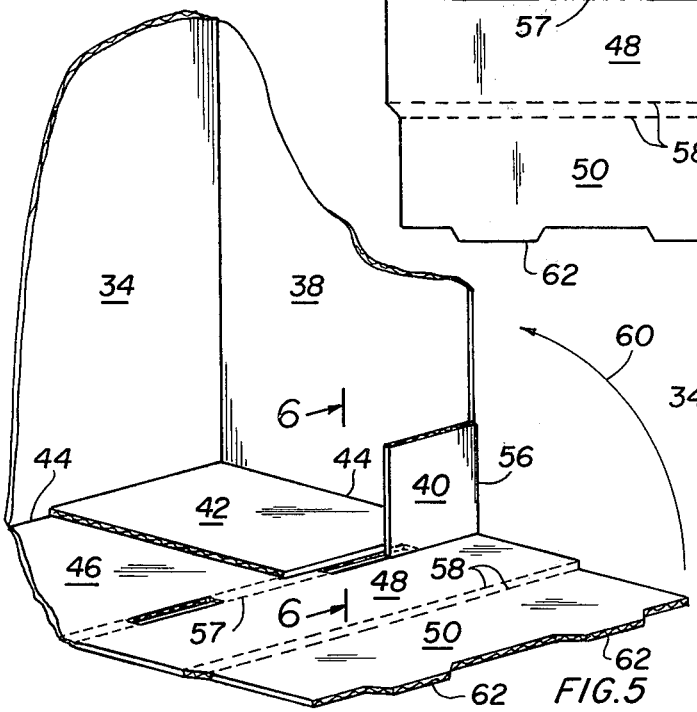
FIG. 5 is a partial perspective view illustrating the manner in which the bottom flaps of the cardboard blank are folded into said three dimensional container.
Figure 6:
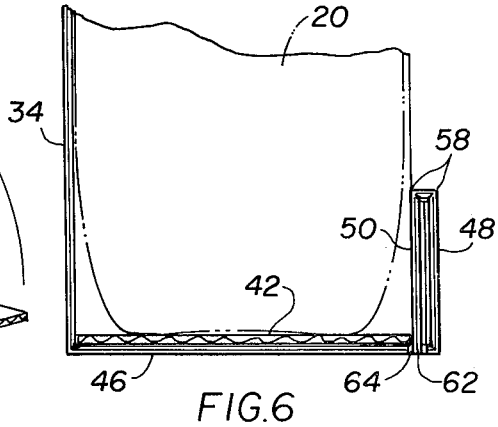
FIG. 6 is a partial end elevational view, in section taken along line 6—6 of FIG. 5, showing further structural details.

To assist in maintaining the erect condition of each pair of the side walls 36, 38 with respect to a cooperating erect or vertically oriented back wall 34, the locking flaps 42 of each of the side walls are folded up along the outer length portion of the fold line 44, as is perhaps best illustrated in FIG. 5. As a result, and as is perhaps now best illustrated in FIG. 6, the locking flaps 42 are in an advantageous position to be contacted by the weight of each anti-freeze bottle 20 which is disposed in each of the product-storage compartments 24. In practice, it has been found that this weight is effective to hold each side wall 36, 38 in its laterally extending position relative to the back wall 34.

Also assisting in holding the side walls 36, 38 in their laterally extending position with respect to each back wall 34 is the other locking flap 40. More particularly, this locking flap is folded in front of its cooperating side wall, as along the fold line 56. Next, and as is perhaps best illustrated in FIG. 5, flap 48 is folded up along the fold line 56, thus moving the flap 48 against the faces of the locking flaps 40. Next, flap 50 is folded over the locking flaps 40, as along the fold line 58 which allows for the thickness of the locking flaps 40, this folding of the flaps 48 and 50 being in the direction 60. Following this, locking projections 62 on the free edge of the flap 50 are inserted behind the locking flaps 40 and projected through the locking notches 64 to thereby complete the formation of a tray-like construction forming an appropriate bottom for each product-storage compartment 24.

From the foregoing, it should be readily appreciated that there has been described herein a novel package 10 which has an initial utility for maintaining in an effective assembled condition three containers 14, 16 and 18. As the need arises, however, an end container is readily removed by rupturing the plastic film 12, as illustrated and as was described in connection with FIG. 2. This selective rupturing of the plastic film 12, however, does not destroy the packaged condition of the remaining containers 16 and 18. In this regard, it is contemplated that the plastic film 12 can be neatly trimmed, as along reference line 66, for the entire length of the circular edge which functions as the film-support 26.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. An improved package for assembled products of the type allowing for partial removal from said assembly of some of said products while a packaged condition is effectively maintained for the remainder thereof, said improved package consisting of an outer plastic protective film in covering relation about at least three identically constructed product containers arranged in side-by-side relation, each said container comprising a cooperating pair of back walls interconnected along an upper edge thereof and disposed in adjacent position with each other such that each is in facing relation to a product-storage compartment, each back wall having flaps extending from the bottom thereof, said flaps folding into a tray-like construction forming a bottom for each said product-storage compartment, and a pair of side walls extending laterally along opposite sides of each said back wall to cooperate therewith in bounding each said product-storage compartment, each said side wall being of a vertical size corresponding to the height of said back walls so that said adjacent position of said back walls provides a corresponding adjacent position in each said pair of side walls contributing to the functioning thereof as plastic film-supports oriented laterally of and at spaced locations along said package, each said side wall having a first locking flap extending from the bottom thereof into said tray-like construction forming said product-storage compartment bottom, whereby the weight of said product placed into said compartment is exerted against each said first locking flap to thereby contribute to maintaining said laterally extending position of said side wall relative to said back wall.

2. An improved package as claimed in claim 1 wherein each said side wall has a second pair of front locking flaps having an operative position engaged to said flaps of said back wall incident to the folding thereof into said tray-like construction, whereby said engagement of said second locking flaps also contributes to maintaining said laterally extending positions of said side walls relative to said back wall.

* * * * *